US007307587B2

(12) United States Patent
Eom et al.

(10) Patent No.: US 7,307,587 B2
(45) Date of Patent: Dec. 11, 2007

(54) HIGH-GAIN RADIATING ELEMENT STRUCTURE USING MULTILAYERED METALLIC DISK ARRAY

(75) Inventors: Soon-Young Eom, Daejon (KR); Soon-Ik Jeon, Daejon (KR); Chang-Joo Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 11/020,600

(22) Filed: Dec. 21, 2004

(65) Prior Publication Data

US 2005/0275590 A1 Dec. 15, 2005

(30) Foreign Application Priority Data

Jun. 10, 2004 (KR) ..... 10-2004-0042594

(51) Int. Cl.
*H01Q 1/38* (2006.01)
*H01Q 1/48* (2006.01)

(52) U.S. Cl. ..... 343/700 MS; 343/848

(58) Field of Classification Search ..... 343/700 MS, 343/846, 848, 767

See application file for complete search history.

(56) References Cited

U.S. PATENT DOCUMENTS 6,081,239 A 6/2000 Sabet et al.
6,114,998 A * 9/2000 Schefte et al. ..... 343/700 MS
6,211,824 B1 * 4/2001 Holden et al. ..... 343/700 MS
6,930,639 B2 * 8/2005 Bauregger et al. ... 343/700 MS
6,940,457 B2 * 9/2005 Lee et al. ..... 343/700 MS
6,946,995 B2 * 9/2005 Choi et al. ..... 343/700 MS

FOREIGN PATENT DOCUMENTS

JP 07-240621 9/1995
KR 1020030013739 A 2/2003

OTHER PUBLICATIONS

X.-H. Shen et al., "Effect of Superstrate on Radiated Field of Probe Fed Microstrip Patch Antenna," IEE Proc.-Micro.Antennas Propag. vol. 148, No. 3, Jun. 2001.

"Stacked Patches Using High and Low Dielectric Constant Material Combinations," Rod B. Waterhouse; *IEEE Transactions on Antennas and Propagation*, vol. 47, No. 1, Dec. 1999.

* cited by examiner

*Primary Examiner*—Shih-Chao Chen
(74) *Attorney, Agent, or Firm*—Blakely, Sokoloff, Taylor & Zafman

(57) ABSTRACT

Provided are a microstrip stack patch antenna using multilayered metallic disk array and a planar array antenna using the same. The microstrip stack patch antenna of the present research concentrates beam patterns and acquires a high gain characteristic by finitely depositing metallic disks in a bore-sight on a conventional microstrip stack patch radiator. The microstrip stack patch antenna includes: a microstrip stack patch directly connected to the feed line; and a mask conductor layer for improving side lobe and gain characteristics, the mask conductor being formed on the microstrip stack patch.

10 Claims, 9 Drawing Sheets

SMP ~ disk 3

Disk 3 ~ disk 7

Disk 7 ~ disk 11

Disk 11 ~ disk 15

HIGH-GAIN RADIATING ELEMENT STRUCTURE USING MULTILAYERED METALLIC DISK ARRAY

FIELD OF THE INVENTION

The present invention relates to a microstrip stack patch antenna using a multilayered metallic disk array; and, more particularly, to a microstrip stack patch antenna using a multilayered metallic disk array which has a concentrated beam pattern and a high gain property by depositing metallic disks on the microstrip stack patch radiator in a direction that electromagnetic waves are propagated, and a planar array antenna using the same.

DESCRIPTION OF RELATED ART

Generally, medium and long-range communication/broadcasting application fields, such as Wireless Local Area Network (WLAN) antenna, and satellite broadcast receiving antenna, require a high-gain and broadband planar array antenna.

Generally, the planar array antenna can obtain a required level of gain by increasing the number of radiating elements. According to the method, however, if the gain of a radiating element is low, the array space between radiating elements is narrow and thus the number of radiating elements should be increased. As a result, the feed network becomes complicated. Also, due to the loss caused by the mutual coupling effect between the radiating element and the feed line and the loss caused by a long feed line, the antenna efficiency is decreased.

On the contrary, if the gain of a radiating element is increased, the array space between the radiating elements is increased in proportion to the increased gain. Thus, the feed circuit network is simplified and the length of the feed line is shortened and, as a result, high antenna efficiency can be obtained.

Due to the advantages that the microstrip patch antenna can be easily fabricated, small in size, lightweight and thin, the microstrip patch antenna is most commonly used in terrestrial broadcasting and satellite broadcasting and communication. However, it has a disadvantage that it has a narrow operation band.

Particularly, it requires a plurality of antennas to receive domestic and overseas satellite signals simultaneously due to a difference in frequency used for the satellite broadcasting and communication.

Also, in case where circular polarization is used, there is an additional condition that the microstrip patch antenna should satisfy the axial ratio characteristic in a corresponding band as well as the characteristic of impedance bandwidth. Therefore, it is hard to improve the performance of the antennas.

FIGS. 1A and 1B present a cross-sectional view and a plane figure of a conventional microstrip single patch antenna.

As illustrated in FIGS. 1A and 1B, the conventional microstrip single patch antenna includes a conductive ground layer 1 in the lower part of a dielectric substrate 2, and a conductive feed line 3 and a first patch 4 which are formed on the upper surface of the dielectric substrate 2.

However, the conventional microstrip single patch antenna has a narrow operation bandwidth and a small element gain of 5 to 7 dBi.

FIG. 2A shows a cross-sectional view of the conventional microstrip stack patch antenna; and FIG. 2B presents plane figures showing a first patch and a second patch of the conventional microstrip stack patch antenna.

As shown, the conventional microstrip stack patch antenna includes a conductive ground layer 21 in the lower part of a dielectric substrate 20, a conductive feed line 22 and a first patch 23 which are formed on the upper surface of the dielectric substrate 20, and a dielectric foam layer 24 formed on the first patch 23 to isolate it from a second patch.

On top of the dielectric foam layer 24, a think dielectric film 25 is placed and then the second patch 26 is formed thereon.

The microstrip stack patch antenna has a broadband impedance characteristic and has a single radiator gain of 7 to 9 dBi, which is relatively high, compared to the microstrip single patch antenna of FIG. 1.

The gain characteristic of the microstrip stack patch antenna is dependent on the electric and physical characteristics of the used dielectric medium. However, if design parameters are optimized to excite input power in a desired frequency bandwidth, single element gain of around 9dBi can be acquired typically.

FIG. 3 is a cross-sectional view showing a conventional microstrip single patch antenna using a dielectric cover having a high dielectric constant.

As shown, the conventional microstrip single patch antenna using a dielectric cover having a high dielectric constant includes a dielectric foam layer 34 having a thickness a little thinner than $0.5\lambda_0$ on the microstrip single patch antenna of FIG. 1A. The thickness makes the electrical wavelength between the single patch and the dielectric foam layer 34 be 180°. On top of the dielectric foam layer 34, a dielectric layer 35 which has a high dielectric constant and a thickness of $0.25\lambda g$ is formed. Herein, the dielectric layer 35 and a first patch 33 will be not described further, since they perform the same operations as the dielectric layer 1 and the first patch 4 of FIG. 1.

The antenna gain of the microstrip single patch antenna using a dielectric cover having a high dielectric constant can acquire a high gain characteristic, but it has a shortcoming that it has a narrow impedance bandwidth.

FIG. 4 is a cross-sectional view showing a conventional microstrip stack patch antenna using a dielectric cover having a high dielectric constant.

As shown, the conventional microstrip stack patch antenna using a dielectric cover having a high dielectric constant includes a dielectric foam layer 47 having a thickness of 0.35 to 0.45 $\lambda_0$ on the microstrip stack patch antenna of FIG. 2A. The thickness makes the electrical wavelength between the stack patch and the dielectric foam layer 47 be 180°. On top of the dielectric foam layer 47, a dielectric layer 48 which has a high dielectric constant and has a thickness of $0.25\lambda g$ is formed. Herein, the dielectric layer 48 and a second patch 46 will be not described any more herein, since they perform the same operations as the dielectric layer 20 and the second patch 26 of FIG. 2A.

The microstrip stack patch antenna using a dielectric cover having a high dielectric constant has a relatively high antenna gain and an improved impedance bandwidth, compared to the microstrip single patch antenna of FIG. 3 which also uses a dielectric cover having a high dielectric constant.

However, the high-gain radiators of FIGS. 3 and 4 which use the dielectric cover utilize a dielectric material having a high dielectric constant. This is the reason that it has a shortcoming of a narrow bandwidth.

In addition, such conventional antennas have a little restriction in high-frequency applications due to their sensitivity to temperature-based electrical characteristics. When the conventional antennas are also used in low-frequency applications, they have a shortcoming that the dielectric material is relatively heavy and expensive.

SUMMARY OF THE INVENTION

It is, therefore, an object of the present invention to provide a microstrip stack patch antenna using a multilayered metallic disk array with a concentrated beam pattern and a high gain property by depositing metallic disks on the conventional microstrip stack patch radiator in a direction that electric waves are propagated, and a planar array antenna using the same.

In accordance with an aspect of the present invention, there is provided a microstrip stack patch antenna, which includes: a microstrip stack patch including feed line and a patch connected to the feed line electrically; and a mask conductor layer for improving side lobe and gain characteristics, the mask conductor being formed on the microstrip stack patch.

In accordance with another aspect of the present invention, there is provided a planar array antenna, which includes: a microstrip stack patch radiator, wherein, when the microstrip stack patch radiator is used to extend the planar array antenna, the distance d between the microstrip stack patch radiators in a direction orthogonal to an excitement or feeding direction can be approximately determined based on $0.9L_e \leqq d \leqq 1.1L_e$, where $$L_e = \frac{\lambda_0}{2\sqrt{\pi}} 10^{\frac{D}{20}}$$

and D (dBi) is directivity.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings. Thus, those skilled in the art can easily embody the technological concept of the present invention. If any detailed description on a widely known technology in relation to the present invention is determined to blur the point of the present invention, it will be omitted. Hereinafter, preferred embodiments of the present invention will be described with reference to accompanying drawings.

In the present invention, it is assumed that a dielectric material used in a dielectric foam layer has nearly an ideal dielectric constant, i.e., $\epsilon_r$=1.05, and the thin thickness of a dielectric film is neglected.

Figure 1A:
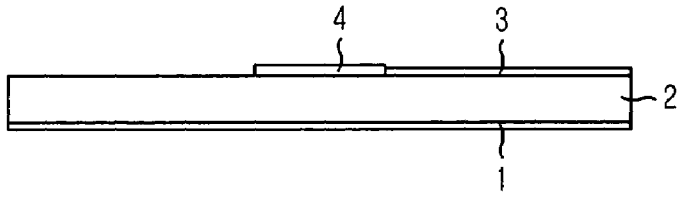
FIG. 1A (PRIOR ART)
FIG. 1A is a cross-sectional diagram showing a conventional microstrip single patch antenna.
Figure 1B:
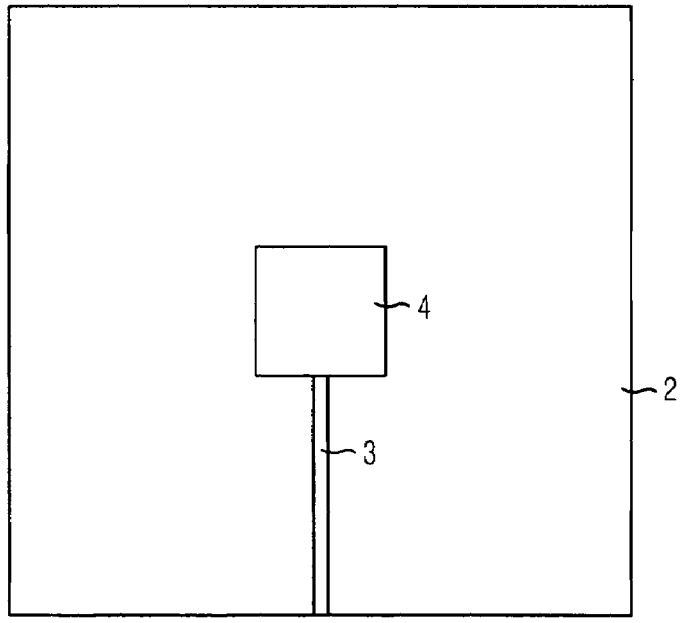
FIG. 1B (PRIOR ART)
FIG. 1B is a top view showing the conventional microstrip single patch antenna.
Figure 2A:
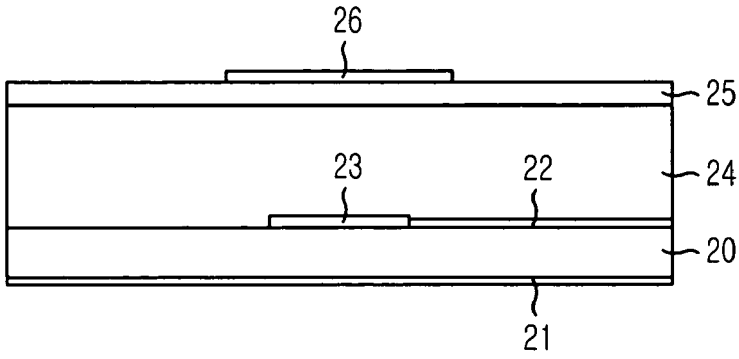
FIG. 2A (PRIOR ART)
FIG. 2A is a cross-sectional diagram showing a conventional microstrip stack patch antenna.
Figure 2B:
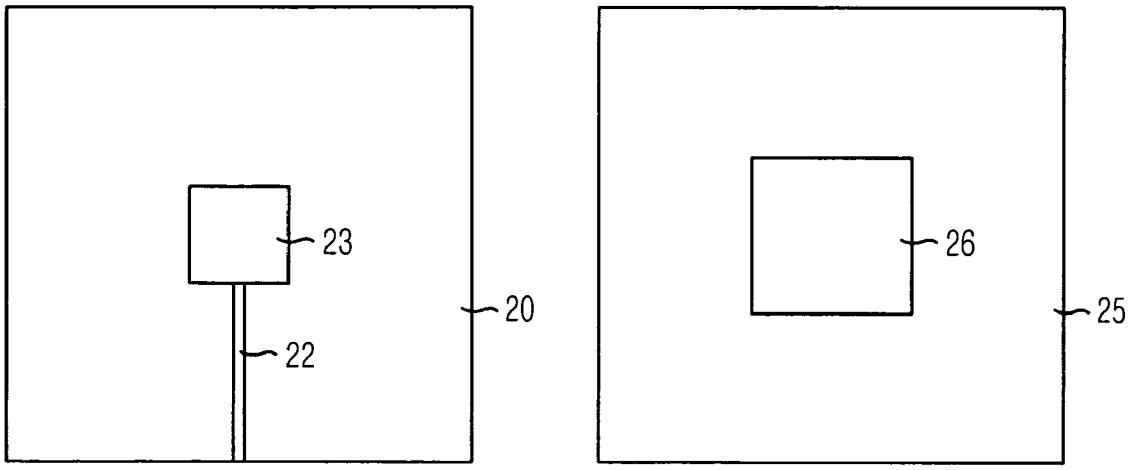
FIG. 2B (PRIOR ART)
FIG. 2B is a top view showing a first patch and a second patch of the conventional microstrip stack patch antenna.
Figure 3:
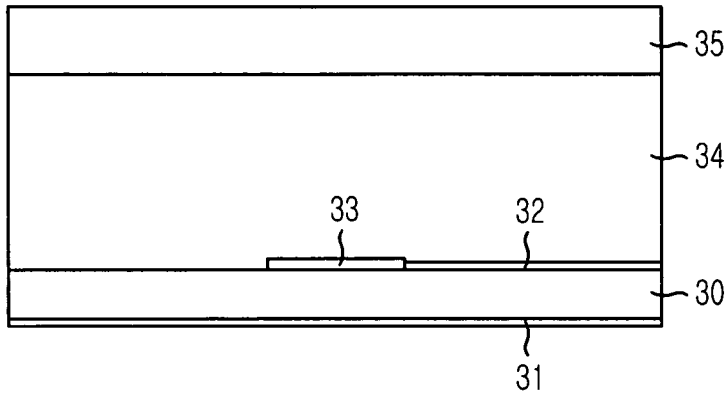
FIG. 3 (PRIOR ART)
FIG. 3 is a cross-sectional diagram showing a conventional microstrip single patch antenna using a dielectric cover with a high dielectric constant.
Figure 4:
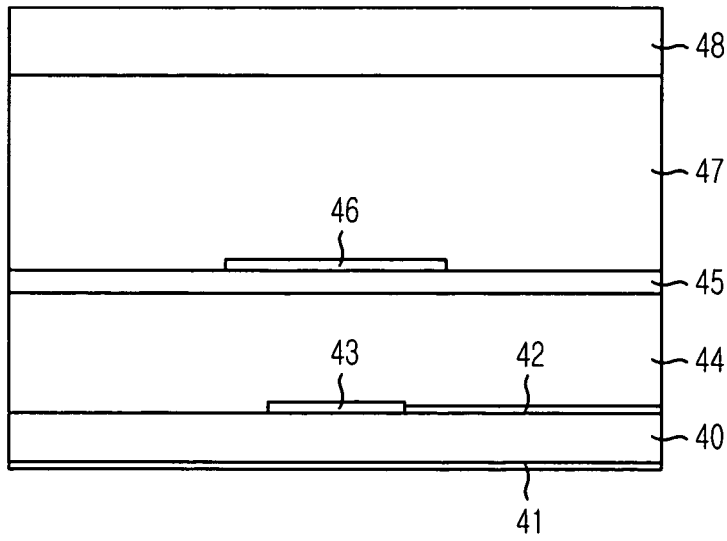
FIG. 4 (PRIOR ART)
FIG. 4 is a cross-sectional diagram showing a conventional microstrip stack patch antenna using a dielectric cover with a high dielectric constant.
Figure 5A:
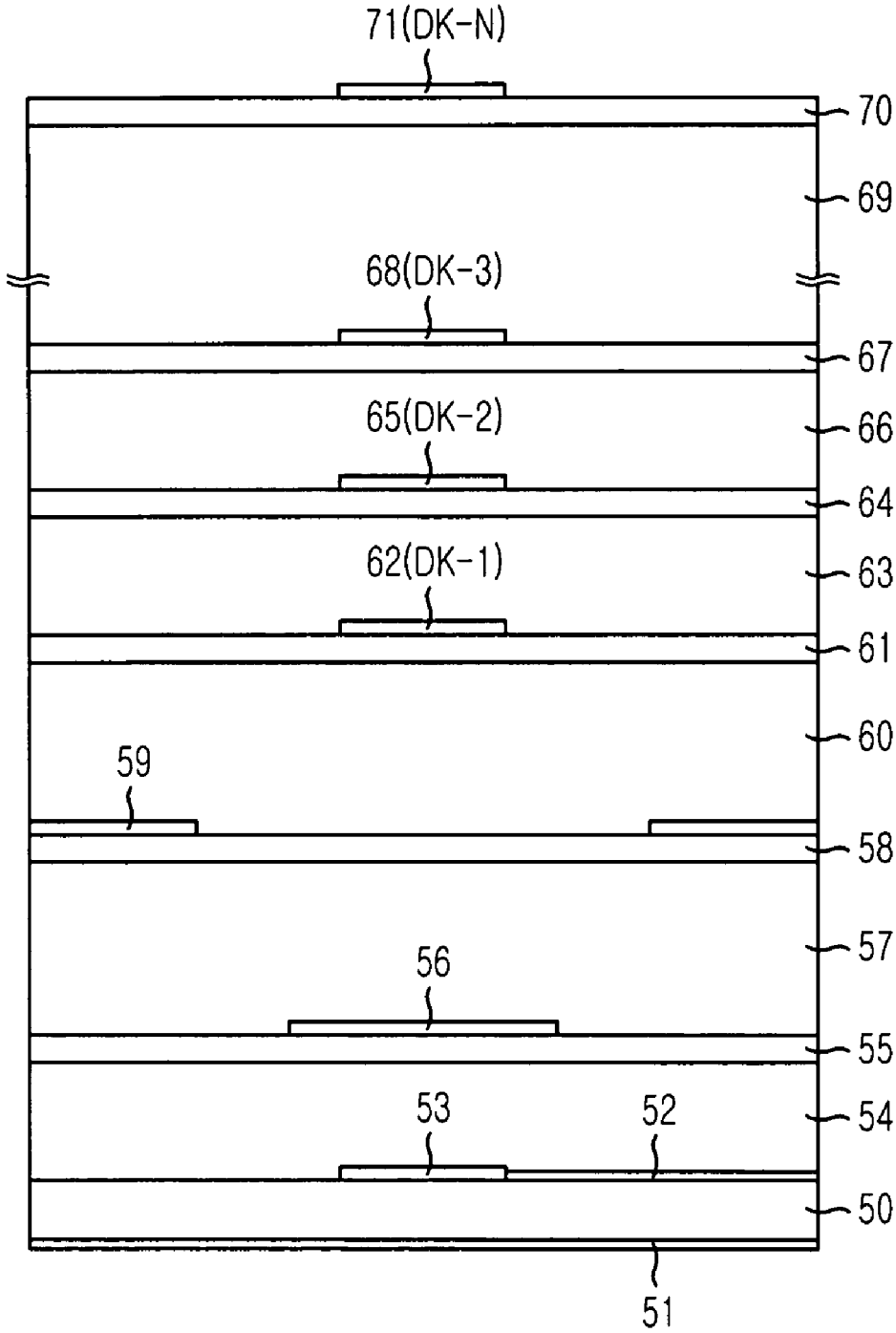
FIG. 5A is a cross-sectional diagram illustrating a microstrip stack patch antenna using a multilayered metallic disk array in accordance with an embodiment of the present invention.
Figure 5B:
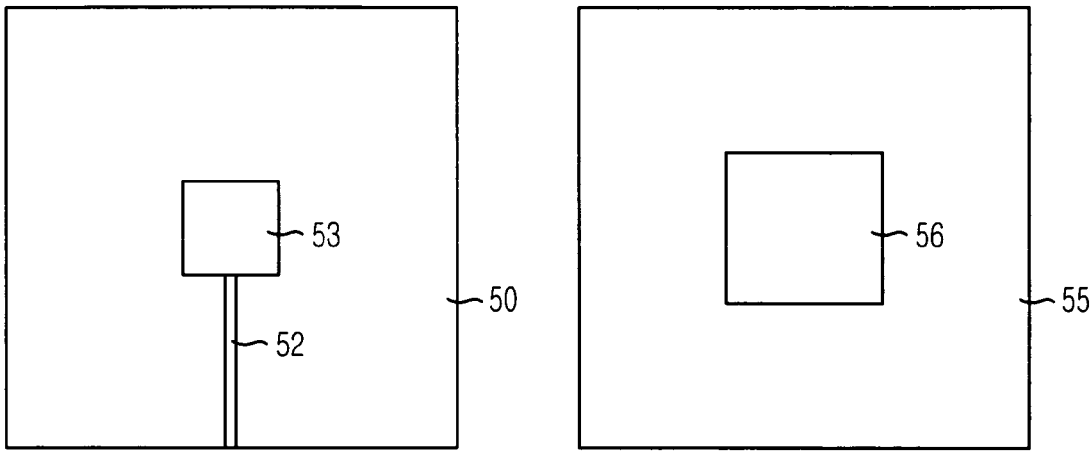
FIG. 5B is a top view describing a first patch and a second patch of the microstrip stack patch antenna using a multilayered metallic disk array in accordance with an embodiment of the present invention.

FIG. 5A is a cross-sectional diagram illustrating a microstrip stack patch antenna using a multilayered metallic disk array in accordance with an embodiment of the present invention, and FIG. 5B presents a top view describing a first patch and a second patch of the microstrip stack patch antenna using a multilayered metallic disk array in accordance with an embodiment of the present invention.

Referring to FIG. 5B, the microstrip stack patch of the present invention comprises a first patch 53 and a second patch 56. The first patch 53 is an active patch with linear polarization, while the second patch 56 is a passive patch with linear polarization.

The first patch 53 is formed on a dielectric layer 50 and a ground layer 51 in the bottom surface and input power is fed to the first patch 53 through an input feed line 52 from an input port.

The second patch 56 is formed on a thin dielectric film 55 and a dielectric foam layer 54 is placed between the first and second patches 53 and 54.

Design parameters of the microstrip stack patch are determined as values having optimal input impedance and gain characteristics through simulation. Although the present invention suggests the square-shaped first and second patches which adopt a direct feeding method and radiate linear polarization, diverse patches and feeding forms can be used according to a required type of polarization.

As illustrated in FIG. 5A, the microstrip stack patch antenna using multilayered metallic disk array, which is suggested in the present invention, includes a mask conductor layer 58, 59 between the microstrip stack patch and the multilayered metallic disk array. The mask conductor layer 58, 59 includes a mask conductor 59 and a dielectric film layer 58.

Hereinafter, the multilayered metallic disk array will be described by taking an example of a case where a metallic disk is used as a conductor.

Between the mask conductor 59, the microstrip stack patch and the multilayered metallic disk array, dielectric foam layers 57 and 60 are inserted.

The multilayered metallic disk-array has a plurality of metallic disks, which are directional radiators, perpendicularly to the microstrip patch radiator with a predetermined space between them in order to obtain a high gain property.

Figure 5C:
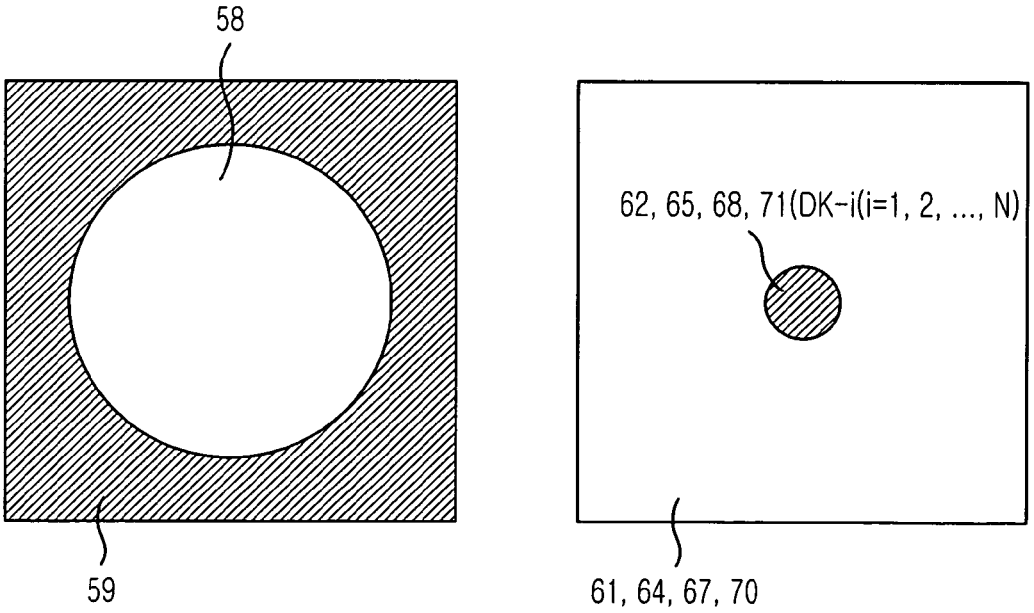
FIG. 5C is a top view illustrating a mask conductor with the center opened and a metallic disk in accordance with an embodiment of the present invention.

FIG. 5C is a top-view illustrating a mask conductor with the center opened and a metallic disk in accordance with an embodiment of the present invention.

As depicted in the left diagram of FIG. 5C, the central part of the mask conductor 59 of the present invention is opened with a diameter of about one wavelength in order to efficiently transmit the power excited from the microstrip stack patch to the multilayered metallic disk array.

The mask conductor 59 improves a side lobe characteristic of a radiation pattern when there is no multilayered metallic disk array and concentrates the radiation pattern into a forward direction. Therefore, it has an effect of improving an antenna gain characteristic.

If there is the multilayered metallic disk array, the mask conductor 59 reradiates reflecting electromagnectic waves into free space through a proper match of the reflecting electromagnectic waves. The gain characteristic is different a little bit according to whether or not the mask conductor 59 is grounded.

As illustrated in the right diagram of FIG. 5C, the metallic disks of the multilayered metallic disk array are arrayed on the same thin dielectric films 61, 64, 67, and 70 in the same center.

As shown in FIG. 5A, it is possible to form the first patch, the second patch, the mask conductor, and the metallic disks to have their centers in the same position or otherwise.

The metallic disks are perfect conductors and the optimal diameter is in the range of 0.25 λ to 0.35 λ, i.e., a non-resonance size. The diameter is one of significant design parameters for determining the antenna gain characteristic.

The thickness of the dielectric foam layer 60 on which a first metallic disk 62 is placed works as a design parameter, too, which is significant for determining the antenna gain characteristic.

In addition, the thicknesses of dielectric foam layers 63, 66 and 69 from the dielectric foam layer 63 on which a second metallic disk 65 is placed to the dielectric foam layer 69 on which an $N^{th}$ metallic disk 71 is placed are significant design parameters for determining the antenna gain characteristic. In the embodiment of the present invention, the dielectric foam layers are deposited in the same and uniform thickness.

However, the dielectric foam layers can be optimized in different thicknesses generally. Also, the metallic disks 62, 65, 68 and 71 are omitted partially and periodically and the position and period of the omitted disk work as design parameters for determining the antenna gain characteristic.

The following table 1 presents a result obtained by simulating the microstrip stack patch, the mask conductor, and the multilayered metallic disk array by using an Ensemble™, which is a commercial simulator, in accordance with an embodiment of the present invention. The design parameters were optimized in an operating frequency of 9.2 to 10.8 GHz ($f_0$=10 GHz).

TABLE 1

| Description of Design parameter | | Value of Design Parameter |
|---|---|---|
| microstrip stack patch | Substrate Spec. (TLY5A) | $\epsilon_x$ = 2.17, $H_1$ = 0.508 mm, T = 0.018 mm |
| | 2nd Patch (Passive Patch) | 11.15 mm(W) × 11.15 mm(L) |
| | 1st Patch (Active Patch) | 10.15 mm(W) × 10.15 mm(L) |
| Mask Conductor | Diameter of Circular Opening | 30 mm |
| | Isolation Height | H = 1.0 mm |
| Metallic Disk Array | Diameter of Metallic Disk | 2r = 9 mm |
| | Number of Metallic Disks | N = 1~15 |
| | Initial Position | $z_1$ = 9 mm |
| | Final Position | $z_L$ = 9~51 mm |
| | Space between Metallic Disks | ds = 3 mm |

In the dielectric substrate with the dielectric constant ($\epsilon_x$) of 2.17, the height ($H_1$) of 0.508 mm and the conductor thickness (T) of 0.018 mm, the design parameter values of the microstrip stack patch are optimized in the operation frequency of 9.2 to 10.8 GHz. It can be seen from the table 1 that the first patch has a width (W) of 10.15 mm and a length (L) of 10.15 mm, while the second patch has a width (W) of 11.15 mm and a length (L) of 11.15 mm.

Also, the mask conductor 59 has the optimal design parameter values when the diameter of the circular opening is 30 mm and the isolation height (H), which corresponds to the height of a dielectric foam layer 57, is 1.0 mm.

In addition, the metallic disks of the metallic disk array have the optimal design parameter values when metallic disks have a diameter of 9 mm, the initial position ($z_1$), which is the height of a reference numeral '60,' of 9 mm, and the spacing (ds) of 3 mm between the metallic disks.

Figure 6:
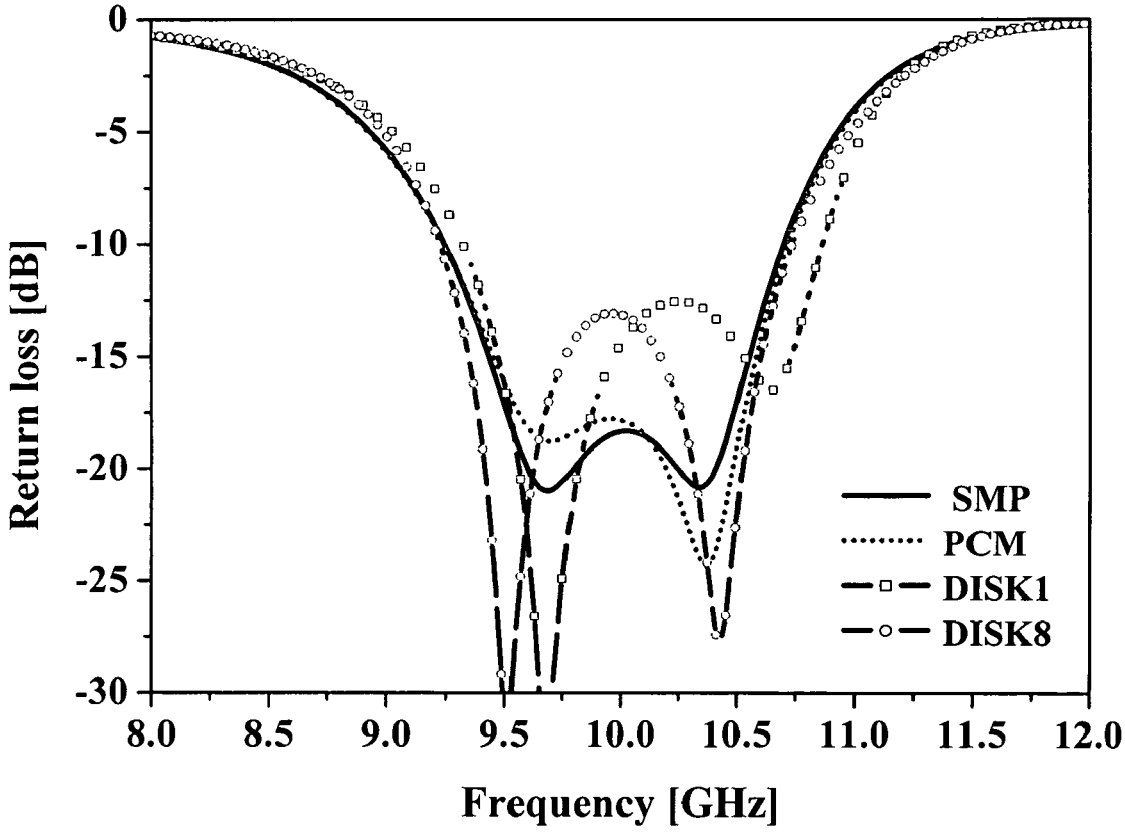
FIG. 6 is a graph presenting an input return loss of a microstrip stack patch antenna using a multilayered metallic disk array in accordance with an embodiment of the present invention.

FIG. 6 is a graph presenting an input return loss of a microstrip stack patch antenna using a multilayered metallic disk array in accordance with an embodiment of the present invention.

As shown, the input return loss of the microstrip stack patch antenna having the mask 59, i.e., perfect conductor mask (PCM) and the input return loss of the microstrip stack patch antenna using the array of the metallic disks 62, 65, 68 and 71 stacked on the mask conductor 59, i.e., disk 1 and disk 8, tend to have a partially improved or degraded electric characteristics in the bandwidth, compared with the input return loss of a simple microstrip stack patch antenna, i.e., a stack microstrip patch (SMP). However, since the changes in the performance are not significant, the characteristics can be regarded to be in the range of acceptance.

Figure 7A:
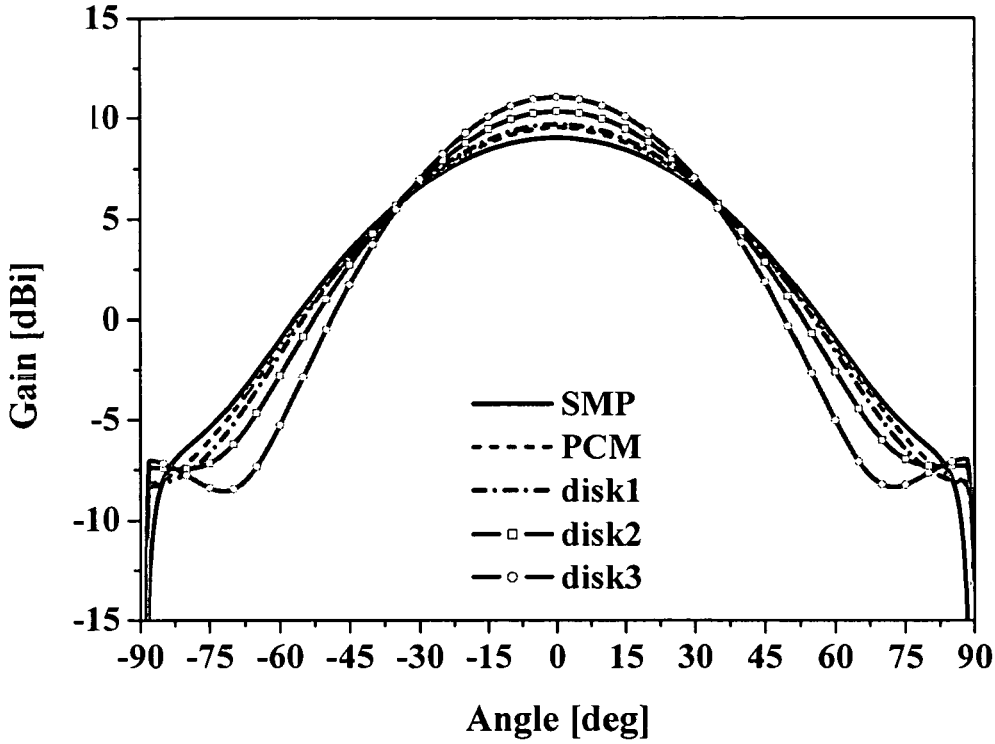
FIGS. 7A to 7D are graphs illustrating radiation patterns dependent on the number of metallic disks deposited in the microstrip stack patch antenna using a multilayered metallic disk array in accordance with an embodiment of the present invention.
Figure 7B:
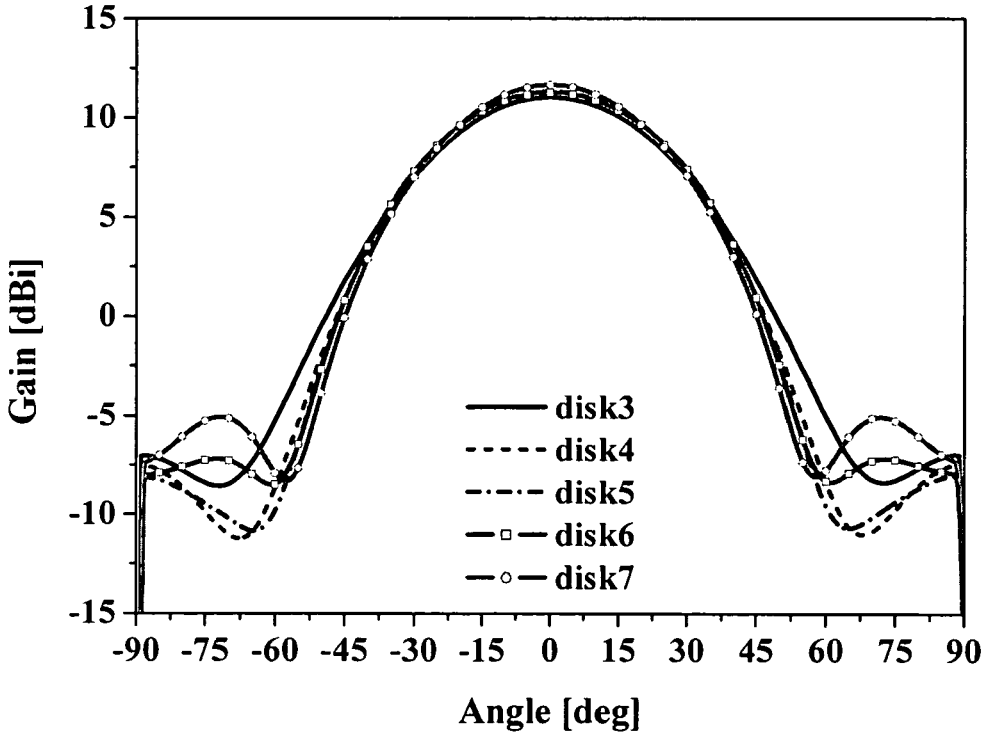

FIGS. 7A and 7B are graphs illustrating radiation patterns based on the number of metallic disks deposited in the microstrip stack patch antenna using a multilayered metallic disk array in accordance with an embodiment of the present invention.

Referring to FIG. 7A, the microstrip stack patch antenna having the mask conductor 59, i.e., PCM, has a higher antenna gain value than the conventional microstrip stack patch antenna, i.e., SMP.

The microstrip stack patch antennas using the metallic disk array, i.e., the disk 1 and disk 8, has a higher antenna gain value than the microstrip stack patch antenna having the mask conductor 59, i.e., PCM. That is, the main and side lobes go up, as the main beam becomes narrower.

Figure 7C:
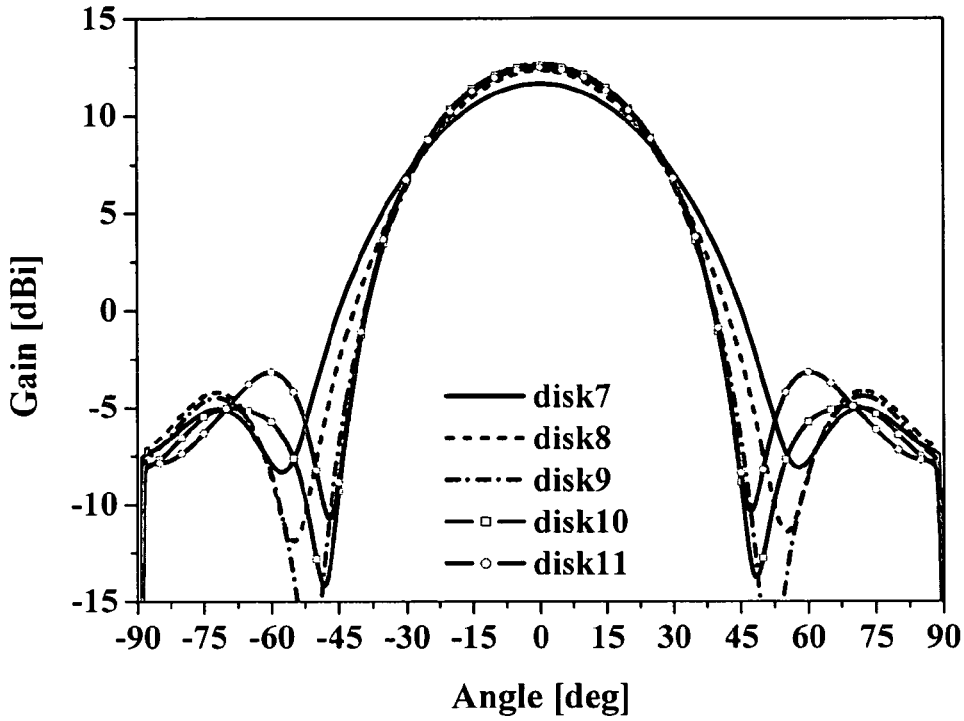
Figure 7D:
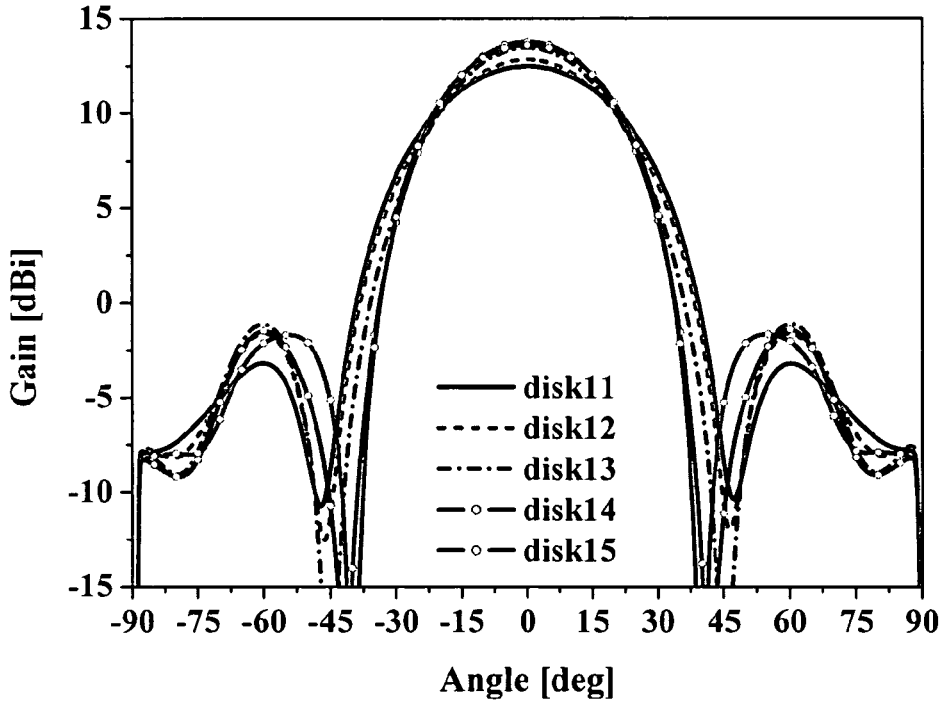

As shown in FIGS. 7B, 7C and 7D, the antenna gain is increased as the metallic disks (the disks 1 to 15) are further deposited.

Figure 8:
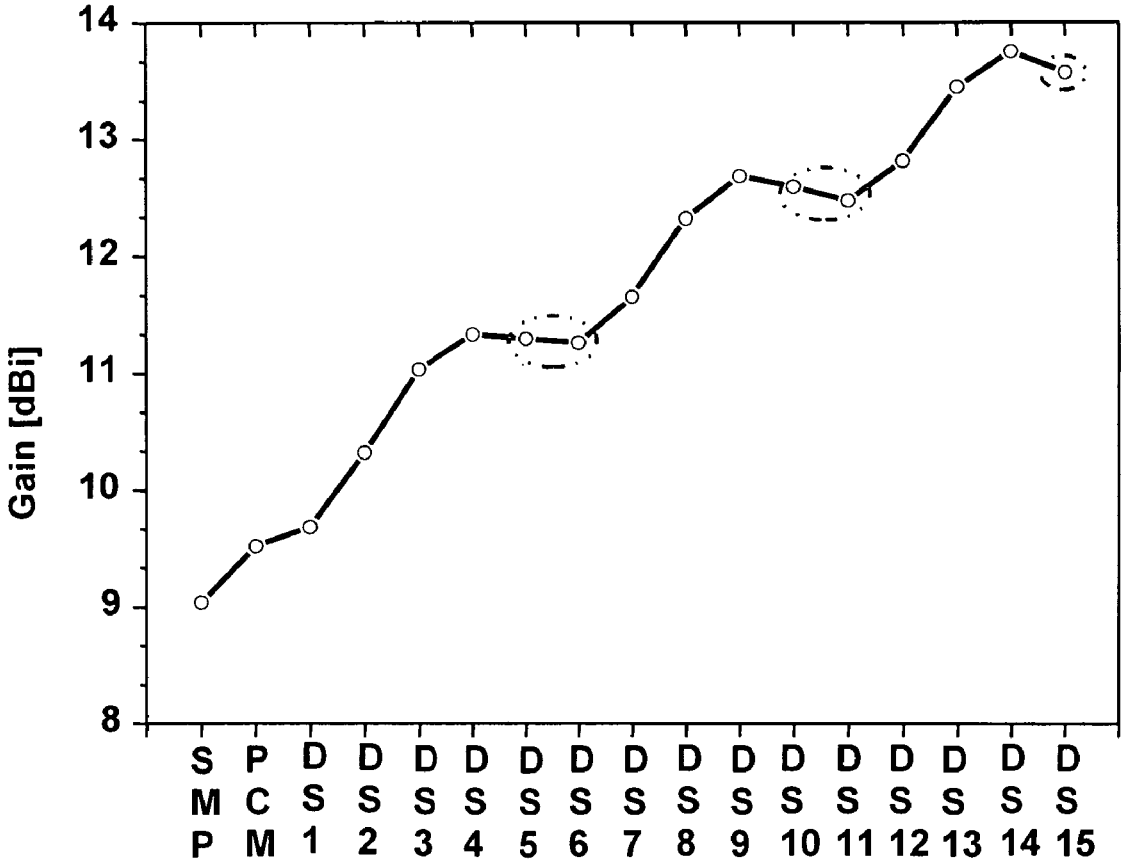
FIG. 8 is a graph describing gain characteristic dependent on the number of metallic disks deposited in the microstrip stack patch antenna using a multilayered metallic disk array in accordance with an embodiment of the present invention.

FIG. 8 is a graph describing gain characteristic based on the number of metallic disks deposited in the microstrip stack patch antenna using a multilayered metallic disk array in accordance with an embodiment of the present invention.

It can be seen from FIG. 8 that the antenna gain is increased and decreased periodically, as the metallic disks 62, 65, 68 and 71 are deposited. This is because the power excited by the microstrip stack patch is periodically and electromagnetically coupled under the equi-phase with the metallic disk array placed in a direction that electromagnectic waves propagate. Also, although the number of metallic disks continues to be increased, the gain is scarcely changed. This is because parasitic disks apart from the microstrip patch exciting radiators have small current amplitude excited.

As presented in the graph of the embodiment, the gain can be improved about 4.5 to 5.0 dB by arraying the metallic disks which have a size smaller than the resonance size on top of the microstrip stack patch.

If the high gain radiators of the present invention is used for extending the planar array antenna, the distance d between the radiators in a direction orthogonal to the excitement direction is determined approximately based on $0.9L_e \leqq d \leqq 1.1L_e$ to reduce interference between radiators. Herein, if it is assumed that current is distributed uniformly in the antenna aperture, $L_e$ can be expressed as the following equation 1:

$$L_e = \frac{\lambda_0}{2\sqrt{\pi}} 10^{\frac{D}{20}} \qquad \text{Eq. 1}$$

wherein D (dBi) is directivity.

The actual distance is selected through simulation to make the coupling quantity between adjacent elements be more than at least 25 dB.

The present invention described above provides a wide impedance bandwith, concentrates electromagnetic waves into a desired direction, and improves the antenna gain by solving the shortcomings of the conventional microstrip patch antenna in the application of the low-frequency and the high-frequency by using the multilayered metallic disk array.

Also, when the radiator of the present is used to extend the planar array antenna, the feeding circuit can be simplified as the distance between the radiators becomes widened relatively and high feeding efficiency can be obtained as the coupling characteristics between the radiators becomes weak. Consequently, the size of the antenna for a required level of gain can be reduced relatively.

The present application contains subject matter related to Korean patent application No. 2004-042594, filed in the Korean Intellectual Property Office on Jun. 10, 2004, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A microstrip stack patch antenna, comprising:

a microstrip stack patch including a feed line and a patch connected to the feed line electrically;

a mask conductor layer for improving side lobe and gain characteristics, the mask conductor layer being formed on the microstrip stack patch and including a mask conductor having an opening in the center;

a stack conductor layer including a dielectric layer formed on the mask conductor layer and a plurality of conductors formed on the dielectric layer; and wherein the opening has a diameter of approximately one operating wavelength ($\lambda_0$), and the plurality of conductors are metallic disks, which are directional radiators.

2. The microstrip stack patch antenna as recited in claim 1, wherein the mask conductor layer includes a dielectric film layer formed on the microstrip stack patch; and the mask conductor formed on the dielectric film layer.

3. The microstrip stack patch antenna as recited in claim 1, wherein the metallic disks have space between the metallic disks and a diameter of between $0.25\lambda_0$ and $0.35\lambda_0$, which is a value of a non-resonance structure.

4. The microstrip stack patch antenna as recited in claim 1, wherein metallic disks are partially and periodically omitted.

5. The microstrip stack patch antenna as recited in claim 1, wherein the conductors of the stack conductor layer have the same central position as the microstrip stack patch.

6. The microstrip stack patch antenna as recited in claim 1, wherein the dielectric layer includes:

a gap layer formed on the mask conductor layer; and a dielectric film formed on the gap layer.

7. The microstrip stack patch antenna as recited in claim 6, wherein the gap layer is a dielectric foam layer.

8. The microstrip stack patch antenna as recited in claim 1, wherein the patch of the microstrip stack patch, the mask conductor of the mask conductor layer, and the metallic disks of the stack conductor layer have the same center.

9. A planar array antenna, comprising:

microstrip stack patch radiators, wherein, when the microstrip stack patch radiators are used to extend the planar array antenna, a distance d between the microstrip stack patch radiators in a direction orthogonal to an excitement or feeding direction is $0.9L_e \leqq d \leqq 1.1L_e$, where $$L_e = \frac{\lambda_0}{2\sqrt{\pi}} 10^{\frac{D}{20}}$$

and D(dBi) is directivity.

10. The planar array antenna as recited in claim 9, wherein each of the microstrip stack patch radiators includes:

a microstrip stack patch radiator having a feed line and a patch connected to the feed line electrically;

a mask conductor layer for improving side lobe and gain characteristics, the mask conductor layer being formed on the microstrip stack patch; and a stack conductor layer including a dielectric layer formed on the mask conductor layer and a conductor formed on the dielectric layer.

* * * * *